US005192019A

United States Patent [19]

Meehan

[11] Patent Number: 5,192,019

[45] Date of Patent: Mar. 9, 1993

[54] PACKAGE PRODUCT DISPLAY BOX HAVING ADJUSTABLE LENGTH FEATURE

[75] Inventor: Kermit E. Meehan, Wayzata, Minn.

[73] Assignee: The Mike Meehan Company, Plymouth, Minn.

[21] Appl. No.: 900,353

[22] Filed: Jun. 18, 1992

[51] Int. Cl.[5] ..... B65D 5/32

[52] U.S. Cl. ..... 229/101; 220/8

[58] Field of Search ..... 229/101, 164, 23 BT; 220/8

[56] References Cited

U.S. PATENT DOCUMENTS

| | | | |
|---|---|---|---|
| 655,939 | 8/1900 | Overton | 229/23 BT |
| 874,442 | 12/1907 | Sandel | 220/8 |
| 1,099,808 | 6/1914 | Martin | 229/23 BT |
| 1,120,955 | 12/1914 | Martin | 229/101 |
| 3,232,439 | 2/1966 | Dahl, Jr. | 220/8 |
| 3,463,343 | 8/1969 | Asenbauer | 220/8 |
| 3,700,159 | 10/1972 | Beigel | 229/23 BT |
| 3,887,102 | 6/1975 | Earley | 220/8 |

FOREIGN PATENT DOCUMENTS

| | | | |
|---|---|---|---|
| 250647 | 9/1947 | Switzerland | 220/8 |
| 614079 | 12/1948 | United Kingdom | 220/8 |

*Primary Examiner*—Gary E. Elkins

*Attorney, Agent, or Firm*—Haugen and Nikolai

[57] ABSTRACT

A point-of-purchase product display box having an adjustable length for the receptacle. The display box comprises first and second telescopically-engaged segments each of generally rectangular parallelepipedon configuration with back panels, a pair of side flaps, and one end flap, all extending at right angles from the back panel. The side flaps of each of the first and second segments have spaced-apart rows of aligned bores formed therein along row axes generally parallel to the common juncture line between the side flaps and the back panel, including an upper row and a lower row with the axes of the separate rows being aligned, and with a number of bores being arranged to permit telescopically-engaged relationship between the segments in either closely coupled or elongated relationship so as to accommodate the available space at the point-of-purchase location.

2 Claims, 3 Drawing Sheets

PACKAGE PRODUCT DISPLAY BOX HAVING ADJUSTABLE LENGTH FEATURE

BACKGROUND OF THE INVENTION

The present invention relates generally to an improved point-of-purchase product display assembly, and more specifically to a package product display box having means to provide an adjustable length for the receptacle. Point-of-purchase displays are widely and extensively utilized in supermarkets and other retail outlets, and are commonly used to display articles in a space which frequently varies from establishment-to-establishment, and which may also vary from time-to-time in the same establishment. Typically, these receptacles are utilized for material which is offered in prepackaged or like-form, such as for example, dairy products, beverage products, frozen confectionery and baking products, and the like. These products are displayed at retail in a variety of environments, such as in a freezer, refrigerator, or room-temperature environment.

Point-of-purchase product display receptacles are typically fabricated from corrugated material, including conventional corrugated or plastic-surface corrugated material. The surface of the material of construction is normally required to be printable in order that indicia, trademarks, slogans, and the like may be imprinted thereon. Other advertising indicia may be placed on such receptacles as well in order to more appropriately inform the purchaser of the nature, quality, or quantity of product being displayed.

As indicated above, the size constraints available for point-of-purchase product display may vary from store-to-store, and may also vary within a given store from time-to-time. For example, in a typical supermarket facility, the manager assigns vendors and merchandise suppliers areas where the products may be displayed. Because of the changing needs of the facility, such as may be dictated by season, economy, and other general needs of the market, the assigned spaces may vary from time-to-time. Furthermore, the products to be displayed may have a different configuration and/or size, and thus the display receptacle must be capable of accommodating articles of various sizes, as well as various numbers of such articles.

SUMMARY OF THE INVENTION

In accordance with the present invention, a point-of-purchase display receptacle and/or assembly is provided which comprises nesting and telescoping first and second segments which mate together to form an open top display container. The container comprises a back panel with upstanding side and end flaps to form the open-top container. The segments include a male segment and a female segment which telescopically engage and/or nest together, with means being provided to secure the individual segments together, one to another, to form the composite open-top container.

Each of the receptacle segments comprises a generally rectangular parallelepipedon with a back panel, a pair of side flaps and one end flap. The flaps extend at right angles from the back panel and form an open-end male and/or female segment. The two segments differ, one from another only in that the end flap is arranged in oppositely disposed relationship, one to another, in order to complete the formation of the receptacle enclosure. The side flaps of the segments each include and incorporate spaced-apart rows of aligned bores formed therein along row axes which are generally parallel to the juncture point between the back panel and the side flaps. The bores include an upper row and a lower row, with the axes of each of the respective rows being positioned to be aligned with a corresponding row on the other display segment. In this fashion, the bores, when aligned, may be pinned with a foldable fastener which has a pair of foldable legs extending from a common head. In order to provide for sufficient rigidity and integrity of the assembly, there are two lines of bores disposed along spaced-apart axes, with the row disposed closer to the common juncture line being substantially fewer in number than those more remote to the common juncture line. In this fashion, the closer-in bores will provide rigidity to the assembly at a point more remote from the respective end walls. The utilization of a more limited number of bores along one of the axes is undertaken in order to preserve carton and/or receptacle integrity, and also to provide a more pleasing appearance.

Therefore, it is a primary object of the present invention to provide an improved point-of-purchase product display receptacle which comprises nesting and telescoping first and second segments which mate together to form an open-top display container of adjustable length dimension.

It is yet a further object of the present invention to provide an improved point-of-purchase product display receptacle which comprises nesting and telescoping first and second segments which mate together to form an open-top display container and which are provided with spaced-apart rows of aligned bores arranged along parallelly disposed spaced-apart axes which are designed to accommodate split metal fasteners which pass through aligned bores.

It is yet a further object of the present invention to provide an improved point-of-purchase product display receptacle which comprises nesting and telescopically engaged first and second segments which mate together to form an open-top display container, and which are provided with parallelly arranged rows of bores, wherein at least one of the rows of bores comprises a lesser number of bores than in the other row, in order to provide greater rigidity in the assembly when the segments are expanded to form an elongated display receptacle, with the pairs of bores being utilized to provide added support and resistance to collapse.

Other and further objects of the present invention will become apparent to those skilled in the art upon a study of the following specification, appended claims, and accompanying drawings.

IN THE DRAWINGS

DESCRIPTION OF THE PREFERRED EMBODIMENT

Figure 1:
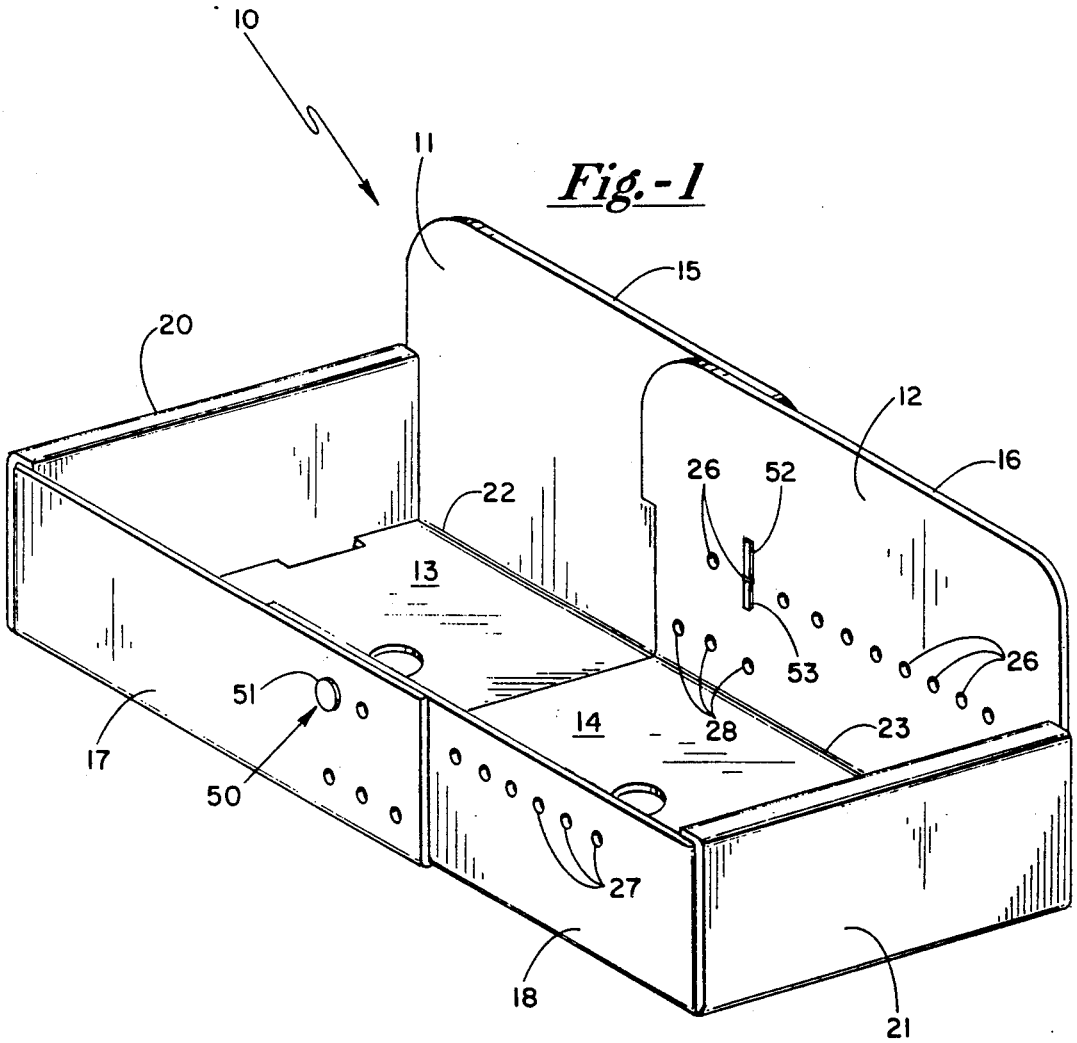
FIG. 1 is a perspective view of the point-of-purchase product display receptacle assembly of the present invention, and illustrating nesting and telescoping first and second segments mated together to form an open-top display container.

In accordance with the preferred embodiment of the present invention, the point-of-purchase display receptacle assembly generally designated 10 comprises a pair of nesting and telescoping segments, including a first segment 11 and a second segment 12. These segments 11 and 12 are arranged to mate together to form an open-top display container with a back panel comprising panel portions 13 and 14 along with upstanding side panels 15 and 16 (back side panels) and front side panels 17 and 18. Additionally, end panels comprising foldable flap members are provided as at 20 and 21. The side panels 15 and 16, for example, join back panels 13 and 14 respectively along a common juncture line as at 22 and 23 respectively. A similar common juncture line is provided between the back panels 13 and 14 and side panels 17 and 18 as at 24 and 25 (see FIG. 2). In the assembly shown in FIG. 1, the first segment comprises a generally rectangular parallelepipedon with its back panel 13, side flaps 15 and 17, and end panel 20. Only one end flap as at 20 is provided, with this arrangement being utilized in order to complete the nesting and telescoping segments and render the segments capable of being nested together to form the open-top display receptacle.

The second segment is shown at 14, with the second segment comprising the male segment of the pair, with the second segment including only one end flap as at 21 so as to permit completion of the assembly.

The side flaps of the first and second segment have spaced-apart rows of aligned bores as at 26—26, 27—27, 28—28, 29—29, 30—30, 31—31, 32—32, and 33—33. As can be appreciated, the arrangement of the rows of aligned bores is such that the individual first and second segments may be coupled together in a closely-coupled arrangement, wherein the outermost bores such as at 26A and 27A will be aligned with and receive a common fastener element with bores 30A and 31A.

Figure 2:
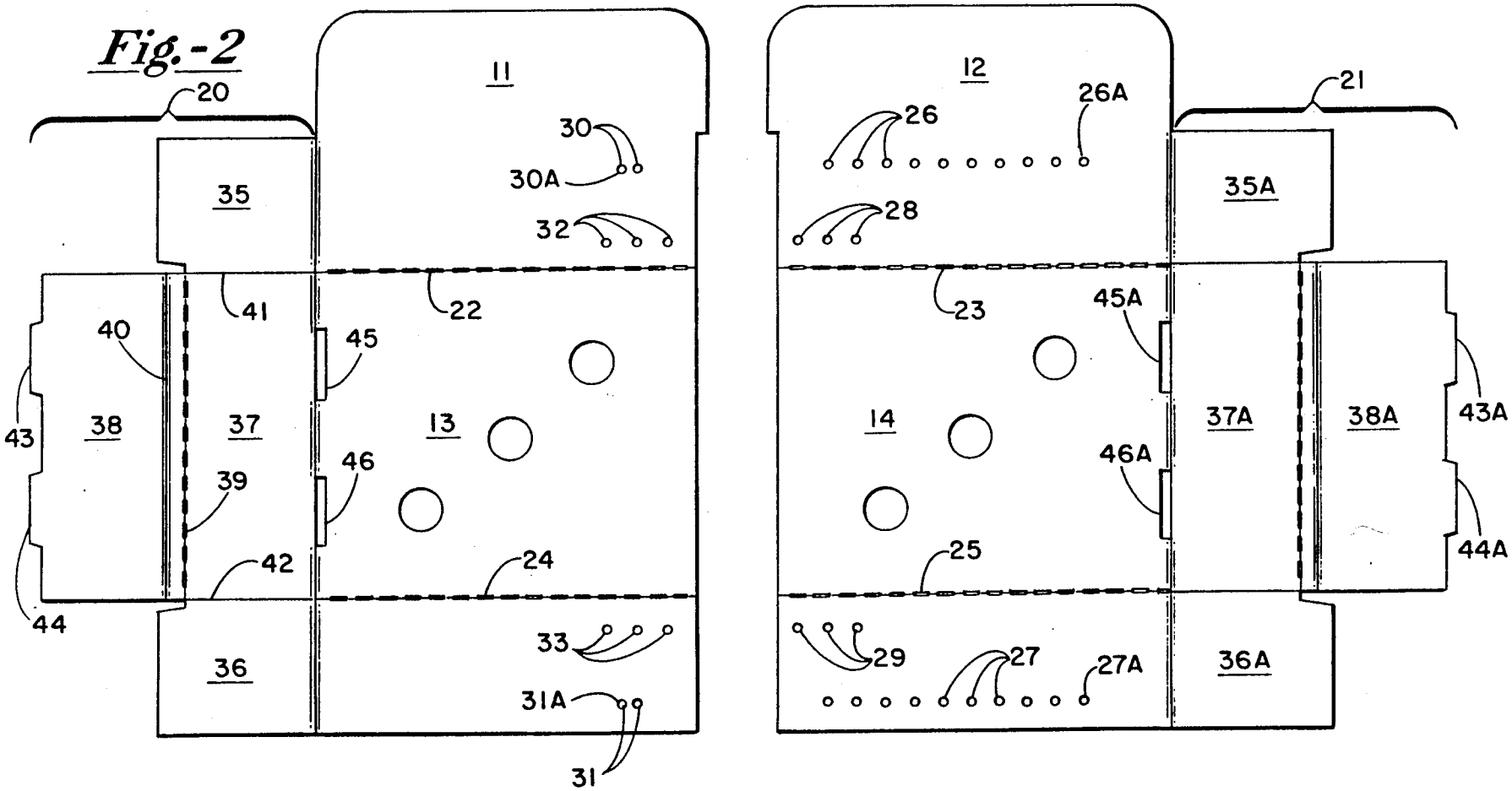
FIG. 2 is a top plan view of the first and second segments of FIG. 1 shown in open and non-assembled form.

As can be ascertained from the views of FIGS. 1 and 2, the assembly is designed to accommodate a variety of lengths of display from one wide display to a relatively narrow and compact display.

Figure 3:
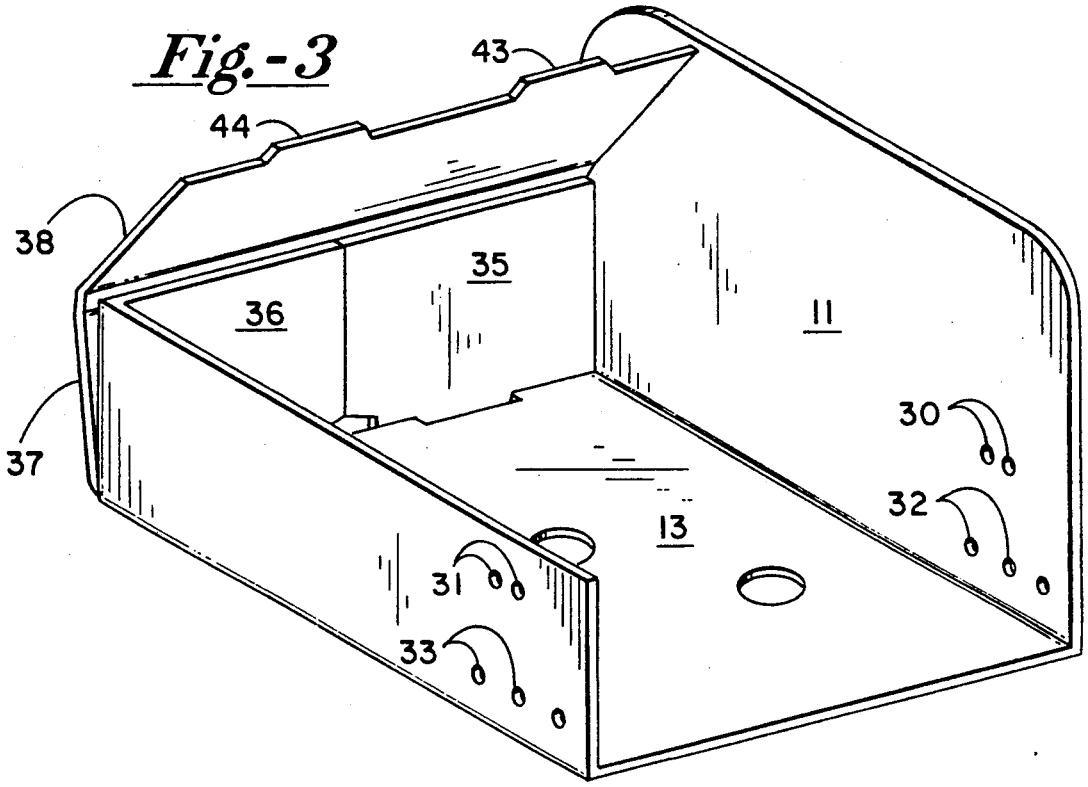
FIG. 3 is a perspective view of one of the segments, specifically the female segment of FIG. 1 in partially erected disposition, and with the fold-over flaps being in partially assembled form.

Attention is now directed to FIGS. 2 and 3 of the drawings wherein the end flap construction is illustrated. Specifically, the end flap comprises a confined or stabilizer flaps 35 and 36, together with a fold-over flap including an outer portion 37 and an inner portion 38, with the portions 37 and 38 being secured together along foldable score lines as at 39 and 40. In the folding operation, stabilizer flaps 35 and 36 are folded inwardly along score lines 41 and 42, and thereafter flaps 37 and 38 are positioned to capture stabilizer flaps 35 and 36 therewithin through folding along score lines 39 and 40 respectively. Tabs 43 and 44 are provided for engagement with rectangular openings 45 and 46, thereby providing greater stability and integrity to the finished product. The opposed end of the assembly is similarly constructed, with end panel 21 comprising segments 35A, 36A, 37A and 38A. These segments are consistent with and mirror images of members 35, 36, 37 and 38 respectively. Additionally, tabs 43A and 44A are provided to engage rectangular openings as at 45A and 46A respectively. Since the operation and fabrication is identical, one to another, with the exception of the slightly smaller size for the member 21, further description is not reasonably deemed necessary.

Once the individual segments have been set up, they are ready to be nested and telescopically engaged together in their mating configuration to form the open-top display container. In the arrangement illustrated, the side panels 15 and 16 are of greater size than the corresponding side panels 17 and 18, thereby providing an area available for receiving printed indicia and representing the type of product contained within the display receptacle.

Figure 4:
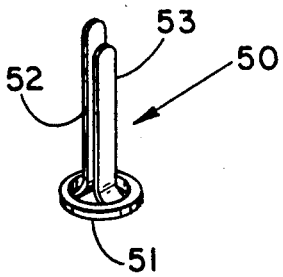
FIG. 4 is a perspective view of a commonly available fastener device which may be utilized to secure the first and second segments together, one to another.
Figure 5:
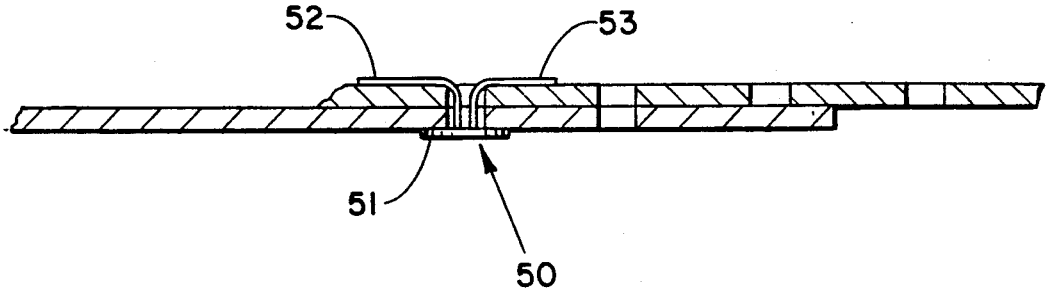
FIG. 5 is a view taken along the axes of a line of bores when the segments are coupled together, with FIG. 5 illustrating the fastener means in its form with the segments coupled together.

Attention is now directed to FIGS. 4 and 5 wherein the assembly arrangement is illustrated. Fastener generally designated 50 is employed, with the fastener including a head 51 and a pair of foldable or spreadable legs 52 and 53. Fasteners of this type are commonly available and have been used for set-up purposes for many years last past. When the appropriate and desired length of receptacle has been achieved, with the aligned bores being arranged therealong, the fastener 50 is inserted into the bore with the legs 52 and 53 being spread in the configuration illustrated in FIG. 5, for example.

Other and further modifications may be made of the apparatus of the present invention without departing from the spirit and scope of the present invention, it being understood that the illustrations provided herein are for purposes of familiarizing those skilled in the art with the concept of the present invention.

What is claimed is:

1. In a point-of-purchase product display receptacle assembly comprising nesting and telescoping first and second mating receptacle segments adapted to mate together to form an open-top display container with each of said segments having a back panel, upstanding side and end flaps, said receptacle segments being characterized in that:

(a) said first receptacle segment comprising a generally rectangular parallelepipedon with a back panel, a pair of side flaps extending from said back panel and forming opposed juncture lines with said back panel, and one end flap extending at right angles from said back panel to form an open-end female segment;

(b) said second receptacle segment comprising a generally rectangular parallelepipedon with a back panel, a pair of side flaps extending from said back panel and forming opposed juncture lines with said back panel; and one end flap extending at right angles from said back panel to form an open-end male segment, with the one end flap of the male segment being arranged in oppositely disposed relationship to the end flap of said female segment;

(c) spaced-apart rows of aligned bores formed in the side flaps of said first and second receptacle segments and being disposed along row axes generally parallel to said opposed juncture lines and including an upper row and a lower row with the axes of each of the respective rows positioned to be aligned with a corresponding row on the other mating receptacle segment, and with the number of bores disposed along the axes closer to each of said opposed juncture lines being substantially fewer in number than those disposed more remote to each of said opposed juncture lines, the arrangement being such that the receptacle segments may be telescopically engaged one to the other in a predetermined selected relationship.

2. The product display receptacle as defined in claim 1 being particularly characterized in that one selected side flap of each side flap pair is provided with a width dimension substantially greater than that of the other side flap of each side flap pair so as to provide an upstanding panel for receipt of printed indicia thereon.

* * * * *